United States Patent [19]

Lantry

[11] Patent Number: 4,564,131

[45] Date of Patent: Jan. 14, 1986

[54] DISPENSING CLOSURE MECHANISM FOR RESILIENTLY SQUEEZABLE RECEPTACLES

[76] Inventor: Gerald F. Lantry, 2002 Ave. G, Council Bluffs, Iowa 51501

[21] Appl. No.: 699,945

[22] Filed: Feb. 8, 1985

[51] Int. Cl.[4] ..... B65D 37/00

[52] U.S. Cl. ..... 222/213; 222/508

[58] Field of Search ..... 222/213, 212, 96, 150, 222/508, 490

[56] References Cited

U.S. PATENT DOCUMENTS

| | | | |
|---|---|---|---|
| 523,254 | 7/1894 | Winkley | 222/213 |
| 1,288,090 | 12/1918 | McNish | 222/213 |
| 2,107,106 | 2/1938 | Crook | 222/529 X |
| 2,857,080 | 10/1958 | Elias | 222/213 |
| 2,908,423 | 10/1959 | Bross | 222/213 |
| 3,868,188 | 2/1975 | Velardi | 222/213 X |
| 4,478,358 | 10/1984 | Lantry | 222/213 |

*Primary Examiner*—Joseph J. Rolla
*Assistant Examiner*—Louise S. Heim
*Attorney, Agent, or Firm*—George R. Nimmer

[57] ABSTRACT

Disclosed are closure mechanism for the open-neck of manually resiliently squeezable receptacles permitting fluids of a wide viscosity range to be dispersed through the open-neck only so long as manual pressure is being exerted against a visually indicated portion of the receptacle deflectable wall. The dispensing closure mechanism generally includes: a cap for the receptacle open-neck and having an outlet-opening; an elongate spindle within the receptacle along the central-axis thereof, the spindle remote of the cap having a trailward-length provided with a circumferential discontinuity type fulcrum and also with a preferably trailwardly convergent shoulder contactable by the manually squeezed receptacle to move the spindle directionally normal to the central-axis; clampably mounted trailwardly of the cap outlet-opening, a centrally-open and stretchable gasket constrictably surrounding the spindle leadward-length; and an adapter separable from the cap but having a longitudinally arrested relationship thereto, the adapter having a fluid-pervious reticulated trailward-skirt pivotably connected to the spindle trailward-length fulcrum and also having a medial flange extending in sealing relationship between the cap and the receptacle open-neck.

11 Claims, 11 Drawing Figures

FIG. 1A
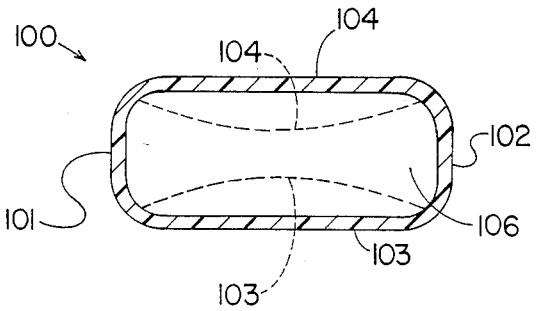
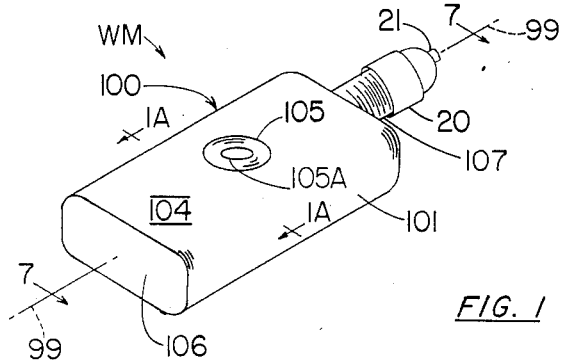
FIG. 1
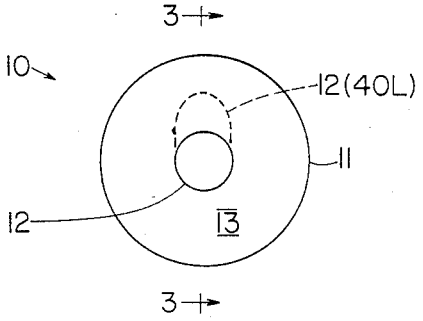
FIG. 2
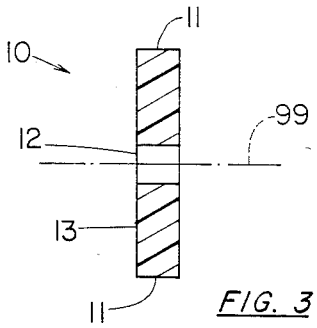
FIG. 3
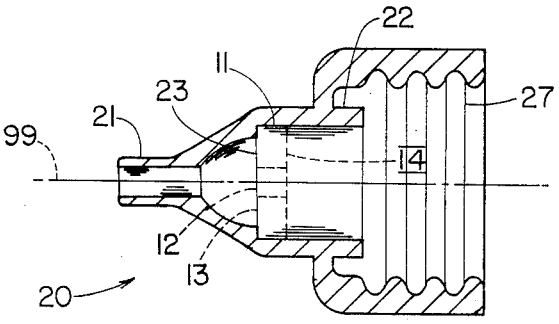
FIG. 4
FIG. 5
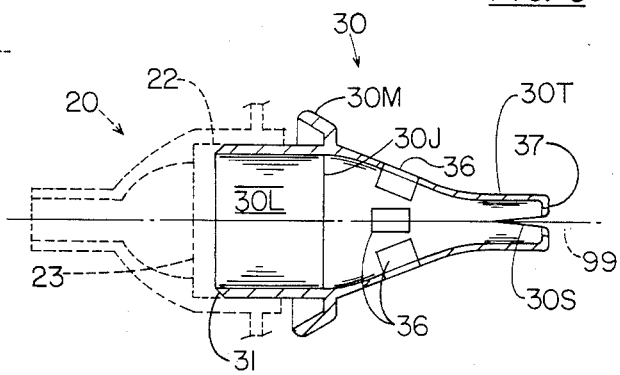
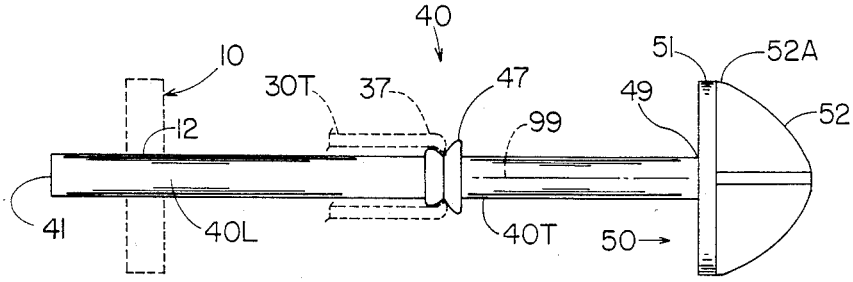
FIG. 6

FIG. 7
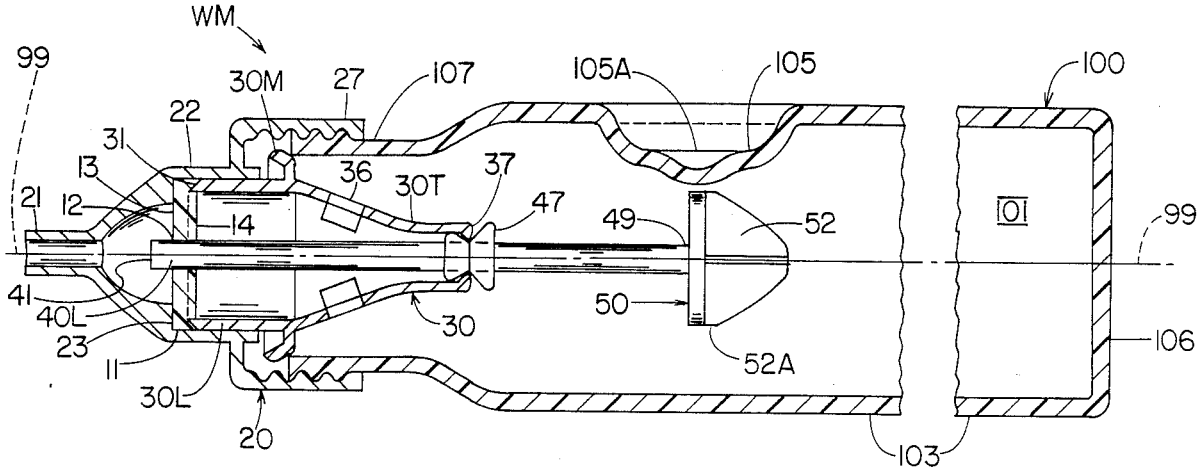
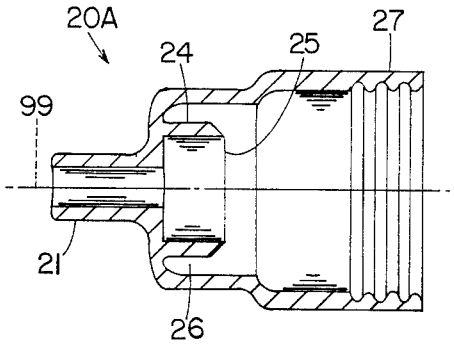
FIG. 8
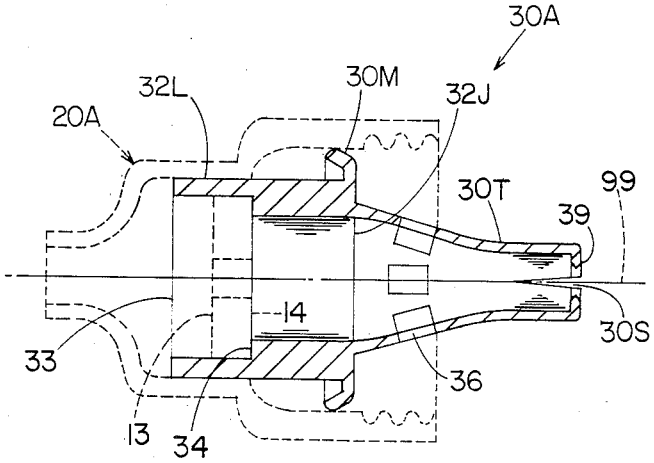
FIG. 9
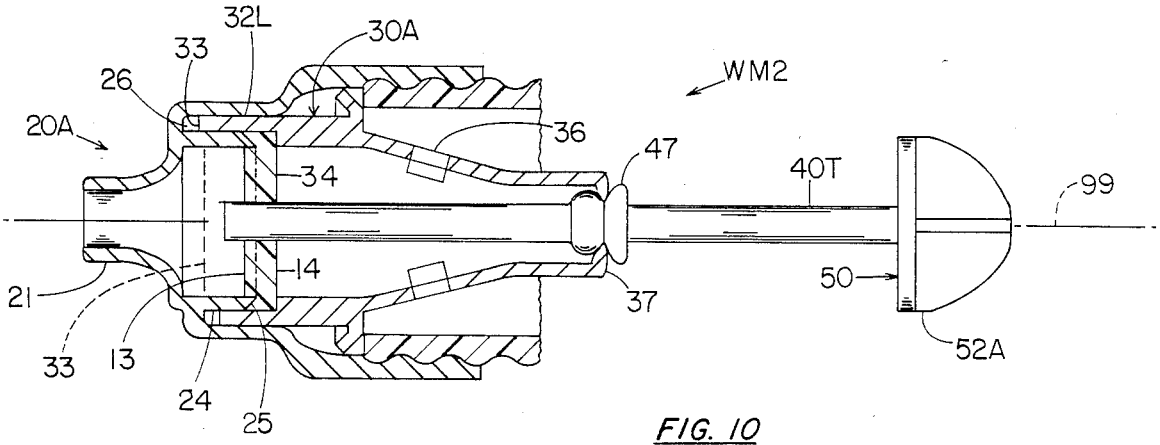
FIG. 10

DISPENSING CLOSURE MECHANISM FOR RESILIENTLY SQUEEZABLE RECEPTACLES

BACKGROUND OF THE INVENTION

Among the relevant prior art, U.S. Pat. No. 4,478,358 (Lantry—Oct. 23, 1984) teaches dispensing closure mechanism for resiliently squeezable receptacles wherein manually exerted squeezing causes an internal spindle (extending along the receptacle central-axis and having a gasket or other yieldable seat) to move against the yieldable seat whereby fluid flow might proceed longitudinally through the yieldable seat and ultimately dispensably through an outlet-opening for a receptacle cap means. The relevant prior art technology is adequate for dispensing fluids having viscosities extending over the lower viscosity ranges.

OBJECT OF THE INVENTION

It is the general objective of the present invention to provide dispensing closure mechanisms for manually resiliently squeezable receptacles wherein manual squeezing causes a spindle (extending along the receptacle central-axis and having a centrally-open gasket seat) to enlarge the gasket central-opening sufficiently to permit the dispensing (through an outlet-opening type cap for the receptacle) of liquid and gel-type fluids having viscosities extending over an unusually broad spectrum ranging from low viscosities to viscosities too high for accommodation by prior art dispensing closure mechanisms.

GENERAL STATEMENT OF THE INVENTION

With the aforestated general objective in view, and together with more specific objectives which will become more apparent as this specification proceeds, the dispensing closure mechanism for manually resiliently squeezable receptacles generally comprises: a cap means provided with a leadward outlet-opening and being removably secured to the open-neck of a resiliently squeezable receptacle extending along a longitudinal central-axis; an elongate spindle extending along said central-axis and including a leadward-length surrounded by the receptacle open-neck and trailward-length, the spindle trailward-length being provided with a circumferential discontinuity type fulcrum such as a circumferential protuberance, a spindle groove, or the equivalent, and the spindle having a trailward rim type shoulder contactable by the manually squeezed receptacle so as to move the spindle trailward-length and leadward-length in directions normal to the central-axis; mounted within the cap means trailwardly of its outlet-opening, a centrally-open gasket constrictably surrounding the spindle leadward-length and the gasket being stretchable in all directions normal to the central-axis and in accordance with the spindle normal directional movement; clamping means surrounding the gasket central-opening to prevent the gasket from being demounted as it is being stretched by the spindle leadward-length; and an adapter separable from the cap means but having a longitudinally arrested relationship to the cap means, said adapter including a fluid-pervious reticulated trailward-skirt that is pivotably connected to the spindle discontinuity type fulcrum and also including a medial flange extending in sealing relationship between the cap means and the receptacle open-neck; and together with other permissible optional features for the dispensing closure mechanism.

BRIEF DESCRIPTION OF THE DRAWING

In the drawing, wherein like characters refer to like parts in the several views, and in which:

FIG. 1 is a perspective view of a first embodiment "WM" of the dispensing closure mechanism in combination with a manually resiliently squeezable receptacle (100);

FIG. 1A is an elevational view of receptacle 100 taken along line 1A—1A of FIG. 1, phantom line indicating resiliency;

FIG. 2 is an elevational view of a centrally-open gasket component for embodiments "WM" and "WM2" of the dispensing closure mechanism;

FIG. 3 is a sectional elevational view taken along line 3—3 of FIG. 2;

FIG. 4 is a sectional elevational view of a cap means component for embodiment "WM";

FIG. 5 is a sectional elevational view of an adapter component for embodiment "WM", and phantom line indicates its spatial relationship to the FIG. 4 cap means;

FIG. 6 is an elevational view of the rimmed spindle component for embodiments "WM" and "WM2";

FIG. 7 is a sectional elevational view of embodiment "WM" taken along line 7—7 of FIG. 1;

FIG. 8 is a sectional elevational view of an alternate cap means component, and employable with embodiment "WM2";

FIG. 9 is a sectional elevational view of an alternate adapter component, and employable with embodiment "WM2". Phantom line indicates its spatial relationship to the FIG. 8 cap means and the FIGS. 2–3 gasket; and FIG. 10 is a sectional elevational view, similar to FIG. 7, of embodiment "WM2" of the dispensing closure mechanism.

DETAILED DESCRIPTION OF THE DRAWING

Turning initially to drawing FIGS. 1–7 which depict first embodiment "WM" of the dispensing closure mechanism for resiliently squeezable receptacles. In addition to a manually resiliently squeezable receptacle (e.g. 100), first embodiment "WM" comprises: a special cap means (20) attachable to the open-neck (107) of such receptacle; a resiliently stretchable centrally-open gasket (10) constrictably surrounding a leadward part of an elongate spindle (40) having a fulcrum (47) and a trailward shoulder (50); and a reticulated (36) adapter (30) leadwardly engaged with the cap means (20) and trailwardly pivoted (37) to the spindle fulcrum part (47). Receptacle 100 extends along a longitudinal central-axis 99 and has two longitudinally separated terminii including a leadward open-neck 107 circularly surrounding and a trailward bottomwall 106 intersecting said central-axis 99. The manually squeezable receptacle 100 also has longitudinally extending wall means such as four interconnected wall-panels (101, 102, 103, 104), and receptacle manually squeezable deflectability is indicated at the phantom line conditions for wall-panels 103 and 104 in FIG. 1A. Receptacle 100 also has visual indicator means, comprising, for instance, depression 105 with inwardly extending dimple 105A, in wall-panel 104, to indicate where manual pressure is to be correctly exerted (i.e. opposite spindle shoulder 50) for causing liquid type fluid (contained within receptacle 100) to be delivered past the receptacle open-neck 107. Open-neck 107 might be threaded to provide one type means for removably securing a special cap means (20, 20A) thereto.

FIGS. 2 and 3 are elevational and sectional views, respectively, of a centrally-open (12) gasket 10 provided of rubber or other resiliently stretchable material, and said gasket being utilizeable for dispensing closure embodiments "WM" and "WM2". Gasket periphery 11 and central-opening 12 respectively circularly surround a central-axis (e.g. 99), and the leadward side 13 and the trailward side 14 of gasket 10 respectively substantially perpendicularly intersect such central-axis 99. Phantom line at 12 in FIG. 2 indicates the resilient stretchability of gasket 10 in directions normal to central-axis 99 when a constrictably surrounded spindle portion (40L) is caused (e.g. by spindle shoulder 50) to pivotably move in a similar normal direction.

FIG. 6 is an elevational view of an elongate spindle 40, which circularly surrounds a central-axis (e.g. 99), the spindle longitudinal length including:

i. a lead-end 41 locatable immediately trailwardly of a cap means outlet-opening (e.g. 21) and also a trail-end 49 locatable deeply inside the receptacle alongside the visual indicator means (e.g. 105,105A), ii. a said leadward-length 40L constrictably surrounded by such gasket 10, and as indicated too by phantom lines in FIGS. 4 and 6, and iii. leadwardly of said trail-end 49, a trailward-length 40T provided with a circumferential discontinuity type fulcrum (e.g. 47). Such discontinuity type fulcrum, which as indicated in FIG. 6 phantom line pivotably supports the trailward-skirt (30T) of an adapter member, might take the form or a medially constricted (e.g. grooved) bead 47 attached in surrounding relationship to the spindle trailward-length 40T. Thus, such bead at its media groove or constriction provides the required fulcrum for the adapter (e.g. 37 at 47). As previously mentioned, carried at the spindle trail-end 49 and in co-longitudinal position with the visual indicator means (105, 105A) is a rim type shoulder having a leadward part 51 abruptly intersecting and circularly surrounding spindle trail-end 49. However, the shoulder trailward side (herein commencing at 52A) is desireably trailwardly convergent (52) to facilitate insertion of the rimmed spindle through the receptacle open-neck during assembly of the dispensing closure embodiments "WM" and "WM2".

Employed as a component for embodiment "WM" is the cap means depicted in the FIG. 4 elevational view and comprising a leadward outlet-opening 21, a trailward cap-skirt 27, and an internally positioned boss 22, all annularly circularly surrounding a central-axis (e.g. 99). Cap-skirt 27 is shown as internally threaded for secure removable engagement to a receptacle having an externally threaded open-neck 107. The aforedescribed resiliently stretchable centrally-open gasket 10 is located at the cap means internal boss (e.g. 22, 24); for embodiment "WM" using cap means style 20, and as indicated in FIG. 4 phantom line, such gasket at its leadward side 13 is cradled at the ledged leadward terminus 23 of annular boss 22.

Finally, there is employed for embodiment "WM" an adapter member 30 depicted in the FIG. 5 elevational view and comprising a tubular leadward-skirt 30L, a medially positioned sealing flange 30M, and a fluid-pervious reticulated (e.g. at openings 36) trailward-skirt 30T. Adapter parts 30L, 30M, and 30T, herein all annularly circulary surround a central-axis (e.g. 99). Though the adapter member (e.g. 30, 30A) is a component manufactured separate from the cap means (e.g. 20, 20A), the adapter is securely removably attachable to the cap means and in a longitudinally arrestd relationship thereto. For example, as indicated in FIG. 5 phantom line, the adapter leadward-skirt 30L is securely frictionally surroundable by the internal boss 22 of cap means 20. Commencing at skirts juncture 30J, trailward-skirt 30T trailwardly converges toward central-axis 99 including at a pivotal connector (e.g. 37) for the spindle circumferential discontinuity (e.g. 47). For adapter members 30 and 30A manufactured of resilient material, the adapter pivotal connector might take the form of a trailward-neck extremity 37 of longitudinally split (30S) trailward-skirt 30T and which extremity 37 can be "snapped" into surrounding pivotal engagement with the constricted bead type fulcrum 47.

In order to permit the gasket central-opening 12 to resiliently stretch to the required degree, it is necessary that the gasket (radially beyond its central-opening) be clampably mounted at the cap means internal boss. For embodiment "WM", wherein gasket 10 is cradled at boss leadward annular ledge 23, the adapter leadward-skirt 30L is provided with a sharpened annular frontal-extremity 31 surrounding gasket central-opening 12 and digging into the gasket trailward side 14.

Turning now to the FIG. 7 assembly elevational view for embodiment "WM". To provide the FIG. 7 assembly:

(a) the said components 10, 20, 30, 40, and 50, and in the inter-relationships previously described, are made into a self-sustaining sub-assembly;

(b) spindle shoulder 50, spindle trailward-lenght 40T, and adapter trailward-skirt 30T are inserted serially through receptacle open-neck 107; and (c) the cap means cap-skirt 27 is removably attached to the receptacle open-neck 107.

In the latter regard, adapter flange 30M extends in liquid sealing relationship between the receptacle open-neck 107 and the cap-skirt 27.

Though already having been alluded to, operation of the FIG. 7 embodiment "WM" for controllably dispensing liquid type fluids contained within manually squeezable receptacles (e.g. 100) might be summarized as follows. When manual squeezing pressure is exerted to the receptacle resiliently deflectable wall-panels (103, 104), they deflect inwardly toward central-axis 99 causing the contained fluid to be squeezed toward open-neck 107 and also through apertures 36. Such manual pressure exerted at the visual indicator means (105) ultimately pushes against the spindle shoulder 50 causing it and trailward-length 40T to move in a direction normal to central-axis 99. However, manual pressure sufficient to so move the spindle attached shoulder is insufficient to disturb the established relationship between open-neck 107, the cap means 20, and the adapter means 30. Thus, as the spindle shoulder 50 is manually actuated to move normal to central-axis 99, the spindle 40 at its stably pivotably secured (37) fulcrum 47 pivots, whereby the spindle leadward-length 40L also moves normal to central-axis 99 so as to drastically enlarge gasket central-opening 12. By virtue of the gasket high resilient stretchability in directions normal to central-axis 99, and coupled with the gasket clampable mounting (e.g. 31, 25, etc.), the gasket central-opening 12 coincidentally drastically enlarges (as indicated in FIG. 2 phantom line) and to such great extent that practically all liquid type fluids, and including those of high viscosity ranges, might be dispensed through the cap means outlet-opening (21).

Dispensing closure mechanism embodiment "WM2" of FIG. 10 differs from FIG. 7 embodiment "WM" only in that the gasket clamping means utilizes the FIG. 8 style cap means 20A and the FIG. 9 style adapter member 30A. Cap means style 20A differs from the FIG. 4 cap means 20 in that the embodiment 20A tubular boss 24 has a sharpened annular rear-extremity 25 digging into the gasket leadward side 13. Adapter member style 30A differs from the FIG. 5 adapter member 30 in that the embodiment 30A has a blunt annular frontal-extremity 33 and has an internal annular shelf 34 against which rests the gasket trailward side 14. Adapter leadward-skirt 32 extends into the cap means annular recess 26 and securely frictionally surrounds the cap means internal boss 24. Thus, the cap means boss sharpened rear-extremity 25 functions as the gasket clamping means, and the dispensing closure embodiment "WM2" of FIG. 7 functions analagously to FIG. 7 embodiment "WM".

From the foregoing, the construction, operation, and improved capability for the dispensing closure mechanism will be readily understood and further explanation is believed to be unnecessary. However, since numerous modifications and changes will readily occur to those skilled in the art, it is not desired to limit the invention to the exact constructions shown and described, and accordingly, all suitable modifications and equivalents may be resorted to, falling within the scope of the appended claims.

I claim:

1. In combination with an elongate receptacle for liquid type fluids and that comprises manually resiliently squeezable deflectable wall means surrounding a longitudinally extending central-axis and comprises as two longitudinally separated terminii a leadward open-neck surrounding and a trailward closed bottom-wall intersecting said central-axis, said receptacle deflectable wall means between said terminii being provided with visual indicator means to indicate where manual pressure is to be correctly exerted for causing fluid delivery past the leadward open-neck, a dispensing closure mechanism for the receptacle open-neck and comprising:

(A) a cp means provided with a leadward outlet-opening for fluid delivery and further provided with a trailward annular cap-skirt secured to the receptacle open-neck, and said cap means trailwardly of the outlet-opening being internally provided with an interior annular boss surrounding said central-axis;

(B) an elongate spindle extending parallel said central-axis, said spindle length including:

i. a lead-end located trailwardly of the cap means outlet-opening, ii. a leadward-length located trailwardly of said lead-end and being surrounded by the receptacle open-neck and the cap means cap-skirt, and iii. a trailward-length located trailwardly of said leadward-length and terminating at a spindle trail-end within said receptacle, said trailward-length being provided with a circumferential discontinuity type fulcrum;

(C) clampably mounted within said cap means at the internal annular boss thereof, a centrally-open gasket surrounding said central-axis, said gasket in directions normal to said central-axis being resiliently stretchable, and said gasket constrictable surrounding the spindle nearer to the lead-end thereof than to the discontinuity type fulcrum;

D. an adapter separable from but having a longitudinally arrested relationship to said cap means, said adapter surrounding the central-axis and the spindle, said adapter including a medial flange portion extending in sealing relationship between the cap means and the receptacle open-neck, said adapter including a tubular leadward-skirt securely removably engaged by the cap means and bearing against the trailward side of said centrally-open gasket and in surrounding relationship to the gasket central-opening, and said adapter including a fluid-pervious reticulated trailward-skirt surrounding and being pivotably secured to the spindle circumferential discontinuity type fulcrum; and E. a rim type shoulder surrounding and attached to the spindle trailwardly of the circumferential discontinuity type fulcrum and being co-longitudinal with the receptacle visual indicator means, whereby maintenance of manual pressure against the visually indicated wall means contacts the rim type shoulder causing it and the spindle to pivot at said fulcrum and resiliently stretch the gasket central-opening to permit fluid delivery therethrough and thence ultimately through the cap means outlet-opening.

2. The combination of claim 1 wherein the centrally-open gasket is cradled within the cap means internal annular boss; and wherein the adapter tubular leadward-skirt has a sharpended frontal-extremity surrounding the central-axis and the gasket central-opening and digging into the gasket trailward side and thereby clampably mounting said gasket within the cap means.

3. The combination of claim 2 wherein the adapter leadward-skirt is securely removably engaged by the cap means by virtue of the leadward-skirt being frictionally surrounded by the cap means internal annular boss.

4. The combination of claim 1 wherein the centrally-open gasket rests against an internal annular shelf of the adapter leadward-skirt; and wherein the cap means internal annular boss has a sharpened rear-extremity surrounding the central-axis and the gasket central-opening and digging into the gasket leadward side and thereby clampably mounting said gasket at the cap means.

5. The combination of claim 4 wherein the adapter leadward-skirt is securely removably engaged by the cap means by virtue of the leadward-skirt being in frictionally surrounding relationship to the cap means internal annular boss.

6. The combination of claim 1 wherein the circumferential discontinuity type fulcrum for pivotably supporting the adapter trailward-skirt comprises a circumferentially grooved head surrounding and attached to the spindle trailward-length.

7. The combination of claim 6 wherein the adapter trailward-skirt includes an annular trailward-neck extremity pivotably surrounding said fulcrum bead at the circumferential groove thereof.

8. The combination of claim 7 wherein the trailward side of the rim type shoulder is trailwardly convergent to facilitate insertion of the rimmed spindle through the receptacle open-neck during assembly of the dispensing closure mechanism.

9. The combination of claim 1 wherein the trailward side of the rim type shoulder is trailwardly convergent to facilitate insertion of the rimmed spindle through the receptacle open-neck during assembly of the dispensing closure mechanism.

10. The combination of claim 9 wherein a terminally sharpened annulus located in surrounding relationship to the central-axis and to the gasket central-opening is employed for clampably mounting the gasket.

11. The combination of claim 1 wherein the said visual indicator means comprises an inwardly extending depression (105) for the receptacle wall means and further comprises an inwardly extending dimple (105A) for said depression (105), said dimple (105A) being in longitudinal position alongside the spindle shouldered portion.

* * * * *